US007963419B2

(12) United States Patent
Burney et al.

(10) Patent No.: US 7,963,419 B2
(45) Date of Patent: Jun. 21, 2011

(54) LID AND CONTAINER

(75) Inventors: Forrest A. Burney, Raleigh, NC (US); Charles Watling, Raleigh, NC (US)

(73) Assignee: BWAY Corporation, Oak Brook, IL (US)

( * ) Notice: Subject to any disclaimer, the term of this patent is extended or adjusted under 35 U.S.C. 154(b) by 359 days.

(21) Appl. No.: 11/539,892

(22) Filed: Oct. 10, 2006

(65) Prior Publication Data

US 2007/0205196 A1 Sep. 6, 2007

Related U.S. Application Data

(60) Provisional application No. 60/776,176, filed on Feb. 23, 2006.

(51) Int. Cl.
*B65D 41/16* (2006.01)
*B65D 41/18* (2006.01)

(52) U.S. Cl. ..... 220/780; 215/344

(58) Field of Classification Search ..... 220/780, 220/789, 790, 792, 794; 215/344
See application file for complete search history.

(56) References Cited

U.S. PATENT DOCUMENTS

| | | | | |
|---|---|---|---|---|
| 3,463,340 | A | 8/1969 | Lindstrom | |
| 3,568,871 | A * | 3/1971 | Livingstone | 215/344 |
| 3,642,167 | A | 2/1972 | Kinney | |
| 3,817,420 | A | 6/1974 | Heisler | |
| 4,210,258 | A | 7/1980 | Von Holdt | |
| 4,256,240 | A | 3/1981 | Woinarski | |
| 4,293,080 | A | 10/1981 | Letica | |
| 4,296,871 | A | 10/1981 | Andersson | |
| 4,305,517 | A | 12/1981 | Dennis | |
| 4,356,930 | A | 11/1982 | Roper | |
| 4,442,947 | A | 4/1984 | Banich, Sr. | |
| 4,453,646 | A | 6/1984 | Harrild | |
| 4,457,447 | A | 7/1984 | Kirkis | |
| 4,518,097 | A | 5/1985 | Milton et al. | |
| 4,524,882 | A | 6/1985 | Buc | |
| 4,560,077 | A | 12/1985 | Dutt | |
| 4,566,601 | A | 1/1986 | Kuenzig | |
| 4,577,776 | A | 3/1986 | Rayner et al. | |
| 4,632,265 | A | 12/1986 | Cochrane | |
| 4,658,977 | A | 4/1987 | Crisci | |
| 4,660,735 | A | 4/1987 | Peschardt et al. | |
| 4,667,843 | A | 5/1987 | Galer | |
| 4,815,620 | A | 3/1989 | Bullock, III | |

(Continued)

FOREIGN PATENT DOCUMENTS

CA 2060982 11/2004

(Continued)

OTHER PUBLICATIONS

Feb. 2, 2010 letter from Kristina Castellano with enclosure.

(Continued)

*Primary Examiner* — Harry A Grosso
(74) *Attorney, Agent, or Firm* — Schnader Harrison Segal & Lewis LLP

(57) ABSTRACT

A lid for a container is disclosed that has a series of seals. The first seal is a rib that is forced against the container interior at a top portion of the container. The second seal is created by at least two ribs that create a spring-like force against the pail. An additional seal is incorporated that includes a skirt having a tear strip with a hook on the tear strip and a hook above the tear strip.

21 Claims, 5 Drawing Sheets

U.S. PATENT DOCUMENTS

| | | | | |
|---|---|---|---|---|
| 4,836,407 | A | 6/1989 | Bruce et al. | |
| 4,887,735 | A | 12/1989 | Dudzik | |
| 4,930,656 | A | 6/1990 | Blanchette | |
| 4,961,512 | A | 10/1990 | Von Holdt | |
| 4,984,701 | A | 1/1991 | Margaria | |
| 5,046,632 | A | 9/1991 | Bordner | |
| 5,097,977 | A | 3/1992 | Straub | |
| 5,125,530 | A | 6/1992 | Straub | |
| 5,328,047 | A | 7/1994 | Smith | |
| 5,460,287 | A | 10/1995 | Cargile et al. | |
| 5,536,161 | A | 7/1996 | Smith | |
| 5,730,309 | A * | 3/1998 | Jiradejnunt et al. | 220/276 |
| 5,873,484 | A | 2/1999 | Clute et al. | |
| 6,279,774 | B1 | 8/2001 | Clute et al. | |
| 6,325,226 | B1 | 12/2001 | Krautkramer | |
| 6,435,384 | B1 | 8/2002 | Davis et al. | |
| 6,460,716 | B1 * | 10/2002 | Wong | 220/4.24 |
| 6,845,877 | B2 | 1/2005 | Diesterbeck | |
| 7,055,708 | B1 | 6/2006 | Haffner et al. | |
| 7,055,710 | B2 * | 6/2006 | King | 215/344 |
| 2007/0272649 | A1 | 11/2007 | Dreyer et al. | |

FOREIGN PATENT DOCUMENTS

| | | | |
|---|---|---|---|
| JP | 10203551 | A | 8/1998 |
| WO | WO 2005039996 | A1 * | 5/2005 |

OTHER PUBLICATIONS

Letter from Olivares & CIA. dated Mar. 1, 2011 providing summary of office action for Mexican Patent Application No. MX/a/2007/002111.

* cited by examiner

LID AND CONTAINER

This application is based on, and claims priority to, provisional application having Ser. No. 60/776,176, having a filing date of Feb. 23, 2006, entitled Gasketless Container and Lid.

FIELD OF THE INVENTION

The invention is related to containers and the associated lids, wherein the lids provide a seal that reduces or eliminates the need for a gasket.

BACKGROUND OF THE INVENTION

The invention, as outlined in the following narrative, is a variation of a molded plastic industrial container of a type in common usage today for the containment and shipping of various substances including, but not limited to, foods and foodstuffs, paints, oils, solvents, and other industrial chemicals. Generally, the container and lid are injection molded from a commodity plastic compound such as high density polyethylene or polypropylene and typically utilize a gasket of compressible foam or rubber between the contact surfaces of the pail and cover to form a liquid tight seal. Containers of this type typically fall within the capacity ranges of 1 gallon up to 10 gallons.

FIG. 1 depicts a prior art pail and lid. The general container configuration in common usage today is comprised of a wide mouth pail commonly referred to as an "openhead" pail, and a lid which affixes over the pail opening. Installation of the lid 1 is accomplished by applying axial pressure to the top of the lid, forcing its mechanical latching features to expand radially over corresponding latching features on the pail until it locates axially into its final position and the latching features relax into corresponding undercuts in the pail exterior.

The lid 1 exterior is generally comprised of a recessed center panel 6, a raised U-channel 7 designed to straddle the top of the pail sidewall, and an outer skirt 24 having a tear strip 8 that extends downward below the level of the panel 6. The pail exterior is generally a tapered cylinder typically having a series of satellite rings 3, 4, 5 around its upper half that may provide additional stiffness to the pail opening and protect the container in the event of a side-oriented drop. These satellite rings may be simple single ribs of plastic extending radially from the pail wall 3, 4 or they may be more geometrically complex rings 5 honeycombed with internal rib structures to provide even more stiffness. Additionally, the pail opening is topped by a thicker, rounded ring or lip 9. In a gasketed container, this pail lip provides both the pail component of the main pail-to-cover latching mechanism and the sealing surface that interfaces with the compressible foam gasket.

SUMMARY OF THE INVENTION

Embodiments of the disclosed invention include a lid for a container that reduces or eliminates the need for a gasket by providing a series of seals. The first seal is a rib that is forced against the container interior at a top portion of the container. The second seal is created by at least two ribs that create a spring-like force against the pail, preferably at the pail lip. An additional seal may be incorporated that includes a skirt having a tear strip. The skirt has a first hook above the tear strip that will engage the pail lip or a rib on the pail after the tear strip is removed. A second hook is position on the tear strip and engages a rib on the pail below the lip or rib to which the first hook engages. This hook is engaged when the tear strip is in place.

DESCRIPTION OF THE DRAWINGS

The invention is best understood from the following detailed description when read with the accompanying drawings.

DETAILED DESCRIPTION OF THE INVENTION

Figure 1:
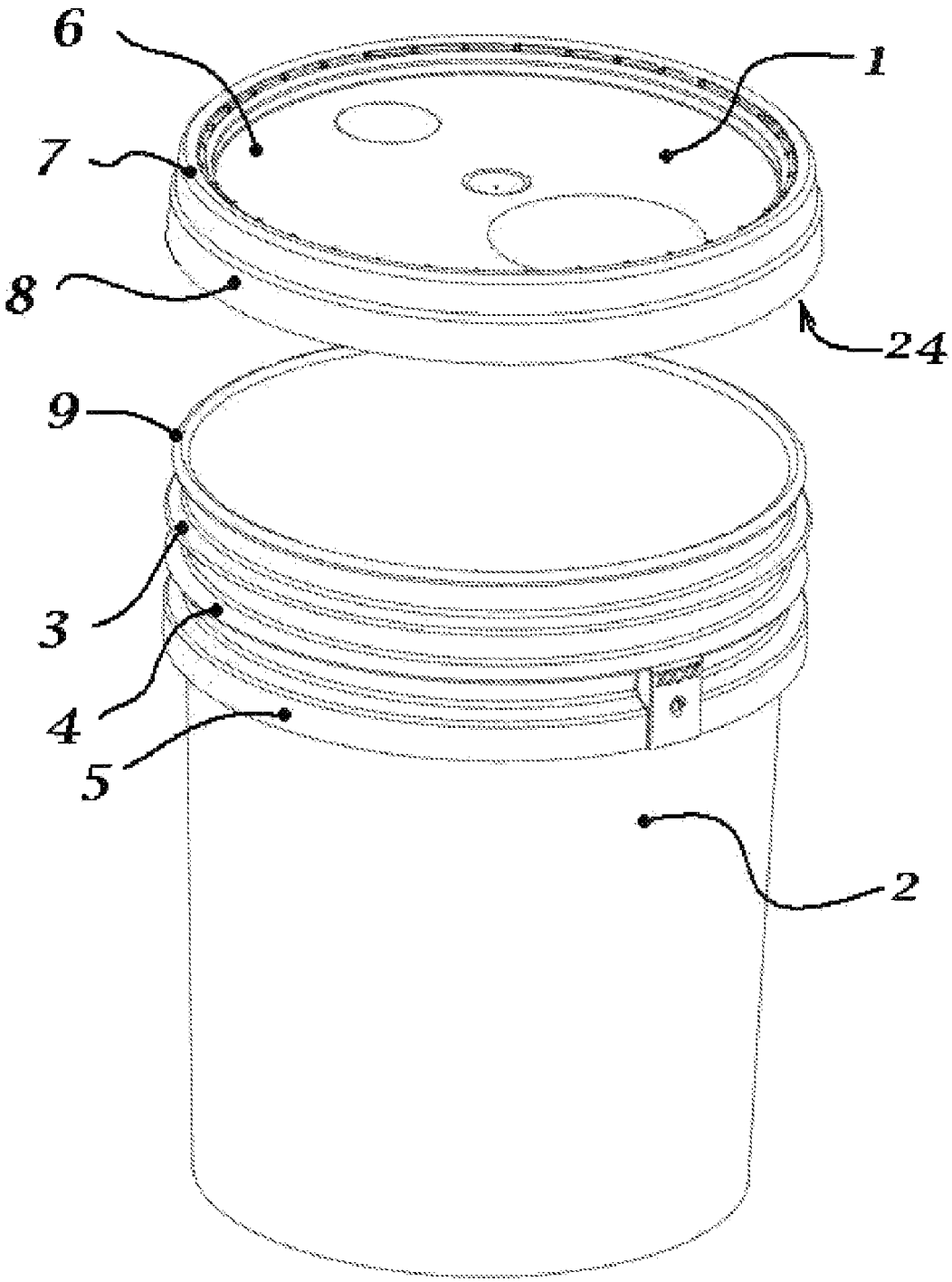
FIG. 1 depicts a prior art pail and lid.
Figure 2:
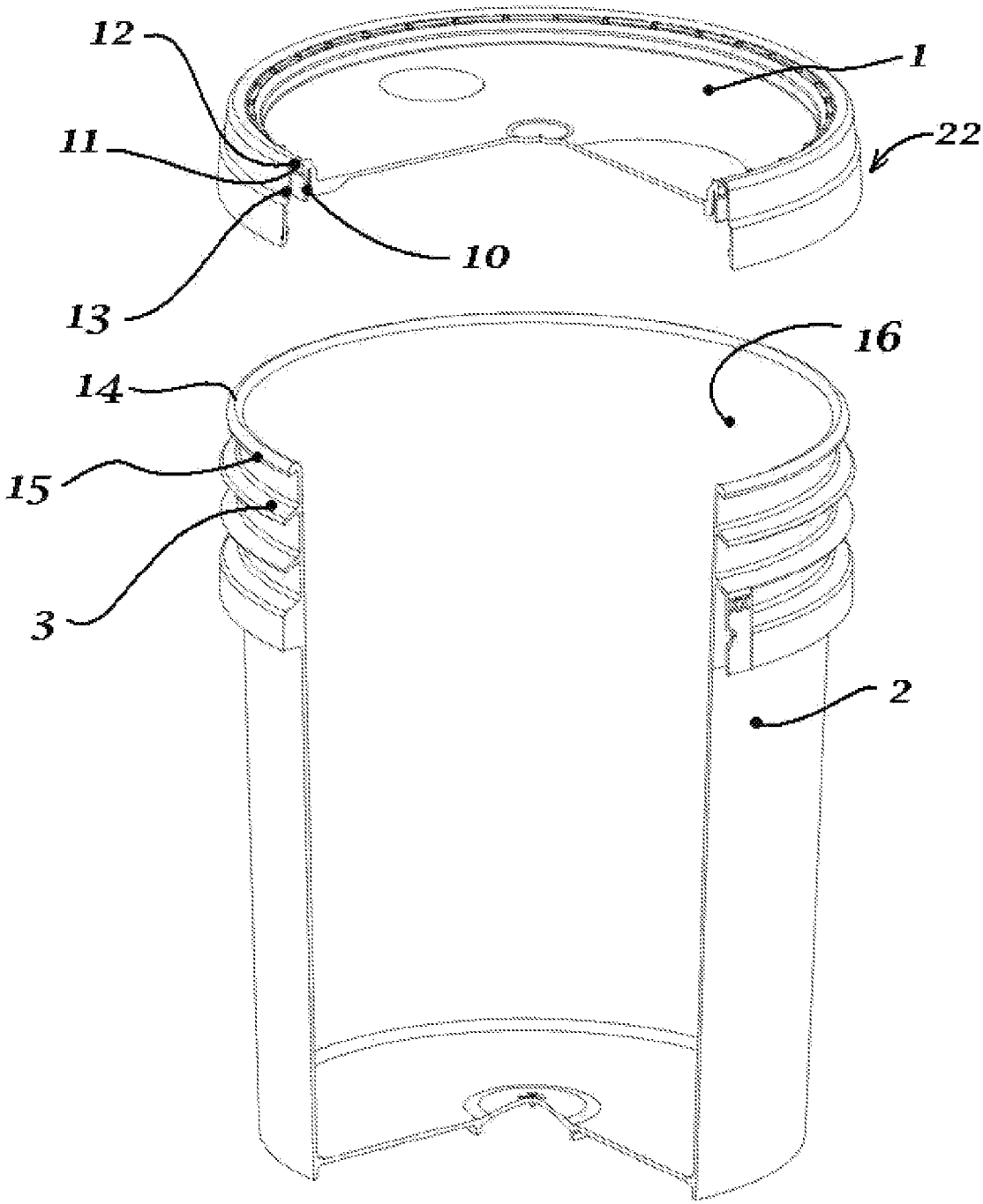
FIG. 2 depicts a cutaway of a lid according to an illustrative embodiment of the invention.

An illustrative embodiment of the inventive pail and lid is shown in FIGS. 2-5 as a wide mouth pail. This illustrative embodiment incorporates features of the prior art pail shown in FIG. 1. The exemplary embodiment of FIGS. 2-5 eliminates or reduces the need for a compressible gasket, utilizing instead distinct plastic-to-plastic sealing mechanisms in combination with a unique latching arrangement to effect a liquid-tight seal. First, a circumferential plastic rib 10 extends downward from the underside of the lid 1. The outer diameter of this rib is tapered and stepped such that, during lid installation, it initially clears the inner pail side wall 16. As the lid is pressed into its final position, the outer diameter of the rib 10 transitions to a larger diameter surface 18 that forms an interference fit with the inner pail wall 16, creating a plug seal similar to that of a cork in the neck of a bottle. Second, two thin, tapered circumferential ribs 11, 12 extend downward at outwardly sloping angles from the underside of the lid's U-channel 7, the outermost of these ribs 12 being somewhat shorter than the innermost rib 11. When the lid is pressed into the latched position on the pail, the innermost rib contacts the top surface 14 of the pail lip 9 and is deflected upward and outward, placing the rib material in tension and forming a compressive plastic-to-plastic seal with the top surface 14 of the pail lip 9. Near the end of its deflection, the longer innermost rib 11 contacts the shorter outermost rib 12, deflecting it also in an outwardly direction. The resulting reciprocal force applied by these ribs in combination against the top surface 14 of the pail lip 9 assures continuous plastic-to-plastic contact, forming a liquid tight secondary seal. Lastly, the inner surface 13 of the outermost wall of the lid is sized such that it is of a diameter smaller than that of the outer surface of the pail lip 15. As the lid 1 is pressed into its final position, this outer lid wall 13 stretches over the outer lip surface 15 of the pail, effecting a tertiary liquid tight seal. The integrity of these three unique sealing mechanisms in combination has been proven liquid-tight under multiple test conditions.

The method of latching this lid to the container is also somewhat unique, and driven, in part, by the requirements of the sealing mechanisms as listed above. In a typical plastic openhead pail and lid assembly, as commercially available today, the primary latching mechanism is a large hook, or undercut, molded as part of the inner wall of the cover's outermost diameter, which deforms during lid application until it passes the pail lip, at which point it relaxes back into shape below the pail lip, securing the lid to the pail. Typically these lids are segmented to facilitate removal, as each segment must be pried away from the pail in series in order to release the hook and remove the lid.

To effect the interference seal between the inner cover surface 13 and outer pail lip surface 15, it is necessary for the cover's outer wall to form a continuous and unbroken surface. This precludes the segmentation of this wall to facilitate cover removal by the end user as is done in a typical openhead pail lid. The gasketless container, therefore, relies on non-traditional latching techniques.

Embodiments of the gasketless container utilize two latches, primary and secondary mechanisms, to affix the lid to the pail and a removable circumferential tear strip 8 to facilitate the initial opening of the container. Tear strip 8 is removable from lid 1 at a point between hooks 19 and 20. The primary latch mechanism, used for the initial lid application by the filler, consists of a circumferential hook feature 19 located far down the inside of the outer wall of the lid which interfaces with the topmost satellite ring 3 of the pail.

As the lid is applied to the pail, the cover hook 19 is forced to expand over the pail's ring 3 until it snaps past said ring and locks into place below it, securing the lid to the pail. The secondary latch, useful only for resealing of the container after the initial opening, consists of a much smaller hook 20 located farther up on the inside of the outer lid wall which, in application, deforms around and snaps under the pail lip 9.

This highlights one of the key differences between the gasketless pail and traditional pails. Where traditional containers may have satellite rings to add stiffness and improve drop performance, the uppermost ring on the gasketless pail is used as a latching feature and its location relative to the corresponding latching feature on the lid is important to performance of the seal mechanisms.

In use, the pail and lid function as follows:

The open pail 2 is filled with its contents.

The lid 1 is placed upon the pail 2 and pressure is applied to force it into its final position. At this point, both the primary 19 and secondary 20 latches have snapped into position and all sealing mechanisms are effectively compressed.

The container is shipped to its retail or wholesale outlet where it is purchased by the end user.

The end user opens the container by gripping the tear tab 17 and removing the bottom skirt section 8 from the lid, effectively removing the primary latching mechanism.

The lid may now be removed by gently prying the remainder of the lid from the pail.

The lid may now be reapplied to the pail by means of hand pressure and the secondary hook becomes the primary latching feature.

The invention will now be described more generally including various embodiments. Lid 1 commonly has a top portion, such as center panel 6, and a side portion 22 extending downward with respect to the top portion along the perimeter of the top portion or from the top edge portion. The term "downward" as used herein does not necessarily indicate a direction perpendicular from the lid top portion, but instead is used in a more general manner to indicate toward ground level when the container is in an upright position. As used herein "top edge portion" refers to an area at or near the perimeter of the lid. The top portion of the lid is disposed over the opening of the container and may extend further outward. The side portion extends from the top portion downward along a portion of the sidewall of the container. The top portion may include a channel, such as the u-shaped channel 7 shown in FIGS. 2-4. The u-shaped channel may have a curved upper portion as shown in the figures, or have a flat top with channel walls substantially perpendicular thereto. Various channel profiles are included in the scope of the invention, provided they are suitable to accommodate the features of the invention.

The lid provides its superior sealing qualities by incorporating a number of features, including protrusions extending from underside of the lid's top portion. A first circumferential rib, such as rib 10, protrudes from the underside of the top lid portion such that when the lid is placed on a container the first rib is forced against an interior wall of the container. In a channel configuration, the first rib will create a space between the channel inner wall and the inner surface if the rib.

Figure 3:
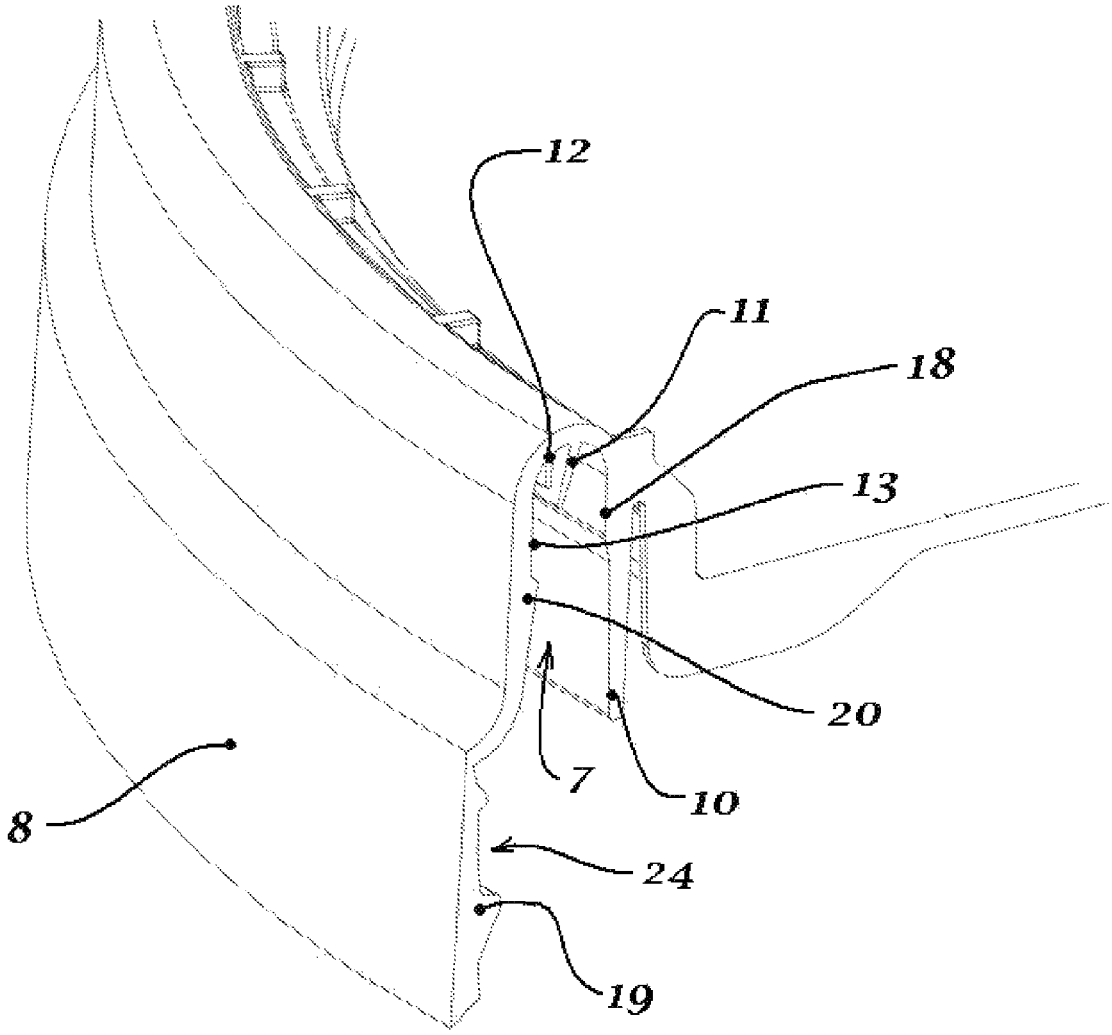
FIG. 3 depicts a cross section of a lid a according to an illustrative embodiment of the invention.
Figure 4:
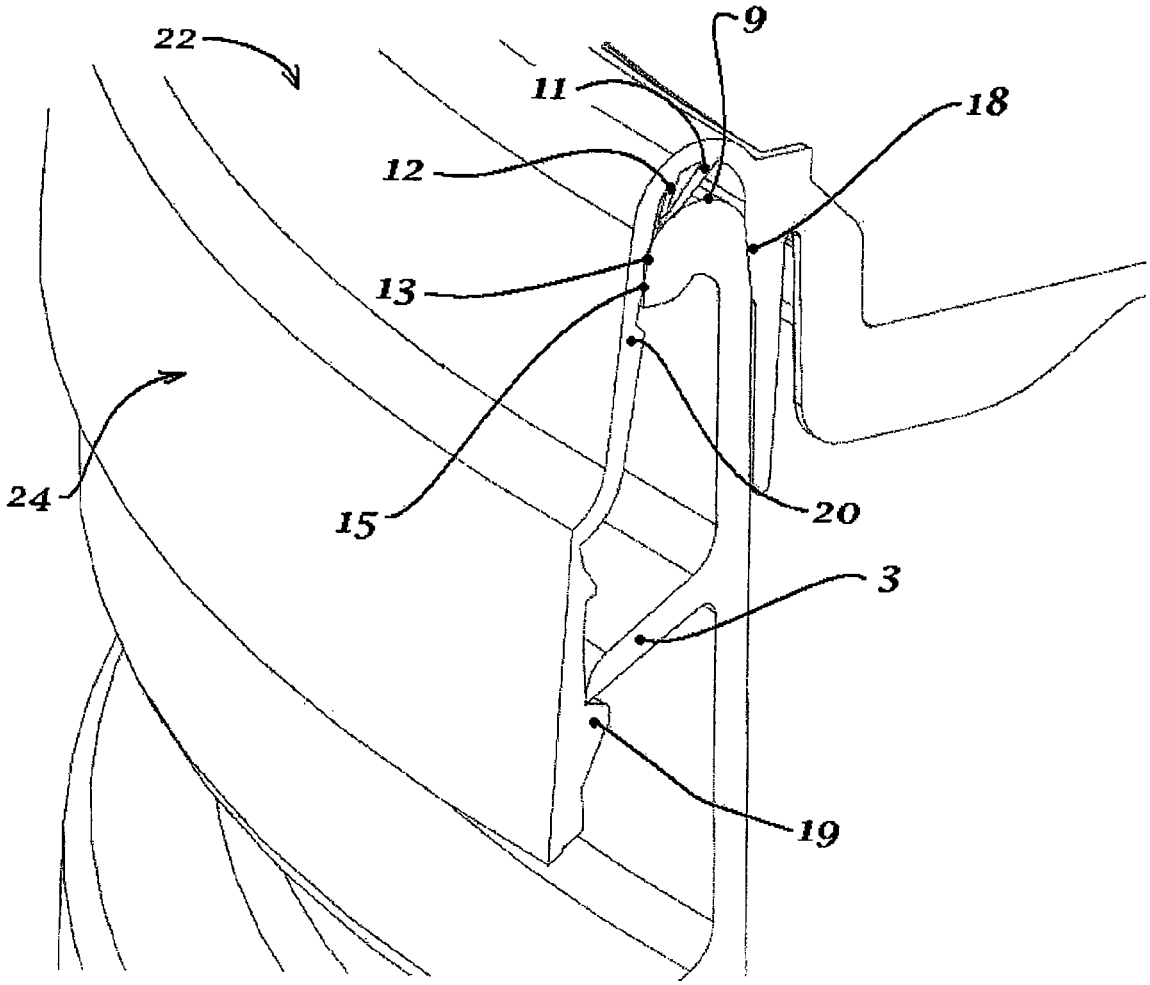
FIG. 4 depicts a cross section of a lid in position on a pail a according to an illustrative embodiment of the invention.
Figure 5:
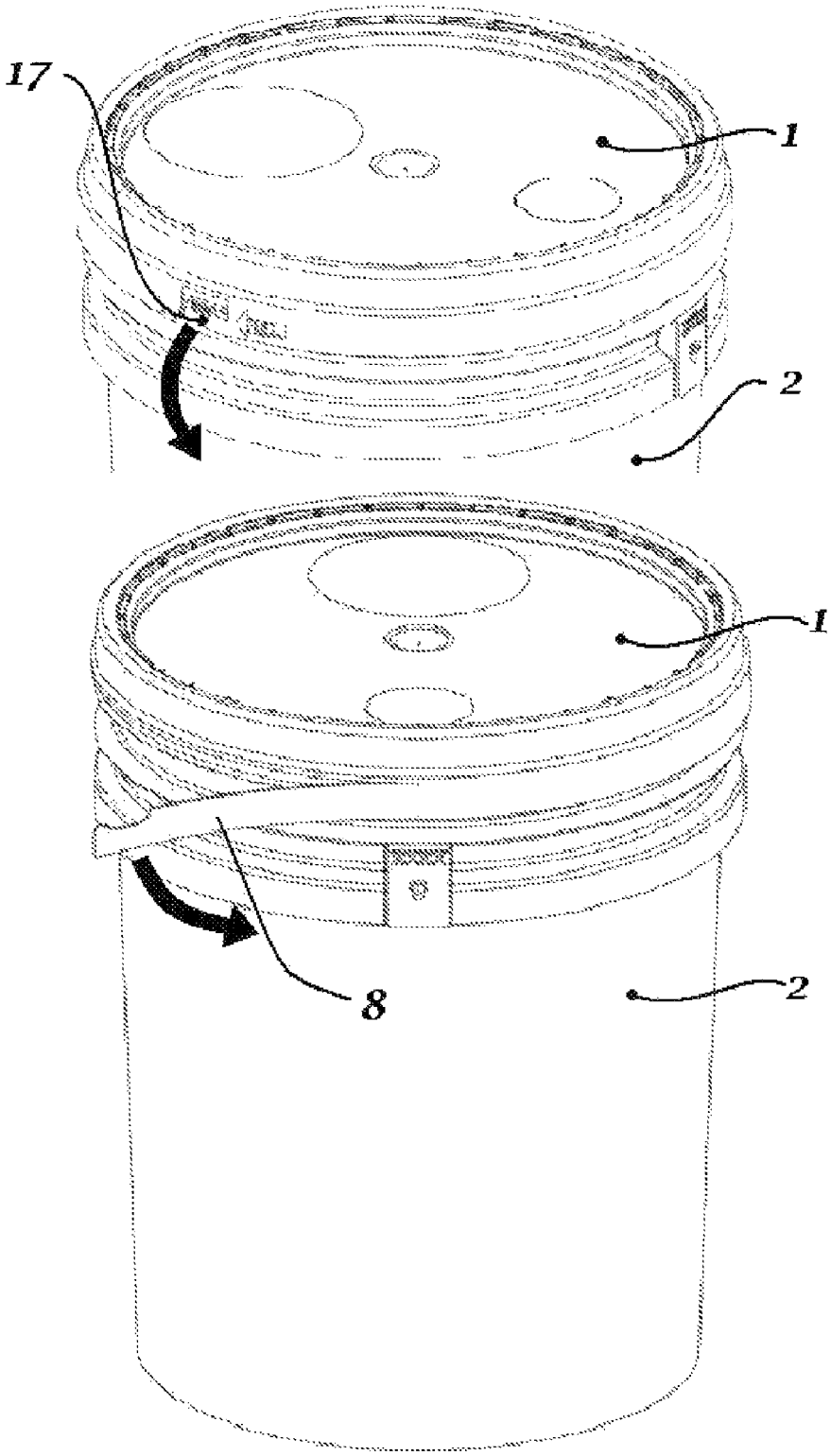
FIG. 5 depicts a lid and pail showing a tear strip a according to an illustrative embodiment of the invention.

A second circumferential rib, such as component 12, and third circumferential rib, such as component 11, each extend from the underside of the top lid portion such that when the lid is placed on the container the second rib is deflected toward and contacts the third rib and the third rib is deflected toward and contacts the container. FIGS. 3 and 4 depict ribs 11 and 12 deflecting outwardly. It is noted, however, that this secondary seal can also be accomplished by the second and third ribs deflecting inwardly or one deflecting inwardly and the other outwardly, provided there is a spring-like force exerted on at least one rib against the container. FIG. 4 depicts the second rib as shorter than the third rib. Depending on the various parameters, such as position of the ribs, deflection direction and lid materials, the third rib may be shorter than the second rib or they may be the same size. Different thicknesses and profiles may also be used to achieve the desired spring-like force that facilitates the sealing property. Additional ribs can be incorporated into the structure to provide extra force for the multi-rib seal or to provide further seals.

An additional seal may be provided by incorporating a skirt, such as component 24, wherein the skirt has a tear strip, such as component 8. The skirt extends from the lid side portion and has two hook closures, such as hooks 19 and 20, extending from the inner surface of the skirt. The hooks latch onto protrusions on the container, such as satellite rings 3, 4 and 5 and lip 9. FIG. 4 depicts a larger hook 19 that engages pail ring 3, and a smaller hook 20 that engages lip 9 after the tear strip is removed. The design shown in FIG. 4 is applicable to the most common pail types on the market that have one or more rings already incorporated into the pail design for stability.

Accordingly, this embodiment of the invention utilizes the existing structural rings. Rings can be incorporated into the pail design specifically to engage the hook, thereby providing additional options. For example, the hooks need not be circumferential, but may be comprised of a group of protrusions at the same height around the pail that can each engage the rib on the pail. It is also possible for the pail rib not to be circumferential. Generally, for manufacturing reasons and ease of lid placement, circumferential ribs and hooks are preferred.

Embodiments of the invention also include a container and lid assembly. The lid and the container can be of any embodiment described herein, provided that the lid is compatible with the container to create the desired seals. FIGS. 1-5 depicts circular lids and pails, however, the scope of the invention includes other shaped pails, such as square and rectangular, for example.

Embodiments of the invention include pails and lids comprised of any material that can have the ribs, protrusions and or lips that effectuate the seals incorporated therein. Generally, the lid features will need some flexibility to allow the ribs to deflect toward the pail to form a seal. The pail material does not necessarily need to be flexible to form the desired seals.

While the invention has been described by illustrative embodiments, additional advantages and modifications will occur to those skilled in the art. Therefore, the invention in its broader aspects is not limited to specific details shown and described herein. Modifications, for example, to the specific pail and lid shapes and materials, may be made without departing from the spirit and scope of the invention. Accordingly, it is intended that the invention not be limited to the specific illustrative embodiments, but be interpreted within the full spirit and scope of the appended claims and their equivalents.

Claimed is:

1. A container lid for use on a container having at least one at least partially circumferential protrusion, the comprising:

a top portion having a side portion extending downward with respect to the top portion along the perimeter of the top portion;

a first circumferential rib protruding from the underside of the top lid portion wherein the first circumferential rib and the side portion of the lip top portion form a U-shaped channel;

a first seal created by the first circumferential rib position such that when the lid is placed on the container the first circumferential rib is forced against an interior wall of the container, and wherein the first circumferential rib transitions to a larger diameter, such that the seal created increases in strength as the lid moves further into the container;

a second seal including a second circumferential rib and a third circumferential rib, each extending from the underside of the top lid portion such that when the lid is placed on the container the second rib is deflected by and contacts the third rib but not the container and the third rib is deflected by and contacts the container, the second and third ribs combining to create a single seal wherein the second rib is positioned to exert a spring-like force against the third rib countering the force exerting by the container on the third rib, thereby increasing the strength of the seal between the third rib and the container;

wherein when the lid is in place on the container, the side portion of the lid top portion stretches over a curved lip of the container and contacts the lip, thereby creating an interference seal as a third seal and when the lid positioned on a container having tapered sidwalls, the force exerted by the first circumferential rib on the interior wall of the container is directed outwardly, thereby strengthening the third seal; and a hook on the side portion facing the container and configured such that when the lid is put in place on the container the hook latches onto one of the at least one circumferential protrusions on the container, thereby securing the lid to the container without threaded engagement: and wherein the combination of seals forms a liquid tight seal without use of a gasket.

2. The container lid of claim 1 further comprising:

a skirt extending from the lid side portion, the skirt having one or more additional hooks extending from the inner skirt surface toward the outer container wall to engage one or more protrusions on the container outer wall, the skirt having a circumferential tear strip incorporating the additional hook.

3. The container lid of claim 1 further comprising:

a circumferential channel in the top lid portion, wherein the lid side portion forms an outer wall of the channel, the channel having its opening on the lid underside such that the channel accommodates an upper edge of the container; and wherein the first rib protrudes from within the channel, thereby creating a space between the rib and each channel wall.

4. The container lid of claim 3 wherein the channel is substantially u-shaped and the first rib extends from an upper portion of the channel and projects toward the outer channel wall.

5. The container lid of claim 4 wherein the second rib and third rib protrude from within the channel from an upper portion of the channel and deflect toward the outer channel wall upon placement of the lid on the container.

6. The container lid of claim 1 wherein the second rib is shorter than the third rib.

7. The container lid of claim 1 further comprising:

a circumferential channel in the top lid portion, wherein the lid side portion forms an outer wall of the channel, the channel having an opening on the lid underside such that the channel accommodates an upper edge of the container; and wherein the second rib and the third rib protrude from within the channel from an upper portion of the channel.

8. The container lid of claim 1 wherein the second rib and third rib deflect in a direction toward the outside of the container.

9. A container and lid assembly comprising:

a lid according to claim 1;

a container having sides with a circumferential top edge portion;

wherein the container's top edge fits between the first rib and the lid side portion and forms a seal between the inner surface of the container and the first rib; and wherein the container's top edge deflects the third rib against the second rib.

10. The container and lid assembly of claim 9 further comprising:

one or more protrusions around the container at given height(s); and a skirt extending from the lid side portion, the skirt having of one or more additional hooks extending from the inner skirt surface toward the outer container wall to engage one of the container protrusions,the skirt having a circumferential tear strip incorporating the additional hook.

11. The container and lid assembly of claim 9 further comprising:

a circumferential channel in the top lid portion having an opening on the lid underside such that the channel accommodates an upper edge of the container; and wherein the first rib protrudes from within the channel from an upper portion of the channel, thereby creating a space between the rib and each channel wall.

12. The container and lid assembly of claim 9 further comprising:

a circumferential channel in the top lid portion having an opening on the lid underside such that the channel accommodates an upper edge of the container; and wherein the second rib and the third rib protrude from within the channel from an upper portion of the channel.

13. The container and lid assembly of claim 12 wherein the channel is substantially u-shaped and the first rib extends from the upper portion of the channel and projects toward the outer channel wall.

14. The container and lid assembly of claim 13 wherein the second and third ribs extend from the upper portion of the channel and project toward the outer channel wall.

15. A container and lid assembly comprising:

a container having a curved lip and tapered side walls;

a lid having a top portion and a side portion extending downward with respect to the top portion along the perimeter of the top portion;

a circumferential channel in the top lid portion, wherein the side portion forms an outer wall of the channel, the channel having an opening on the lid underside such that the channel accommodates the container lip;

a first circumferential rib positioned on the lid such that when the lid is placed on the container the first circumferential rib is forced against an interior surfaceof the container wall due to the tapered container walls, and wherein the first circumferential rib transitions to a large diameter, such that the first circumferential rib exerts a force on the inside of the container wall outward creating a seal that increases in strength as the lid moves further into the container;

a second rib extending from the upper portion of the channel and at an angle from the normal so it extends toward the outer channel wall;

a third rib extending from the upper portion of the channel and at an angle from the normal so it extends toward the outer channel wall, the third rib positioned between the first and second ribs such that when the lid is placed on the container the second rib is deflected by and contacts the third rib but not the container and the third rib is deflected by and contacts the container, the second and third ribs combining to create a single seal wherein the second rib is positioned to exert a spring-like force against the third rib countering the force exerting by the container on the third rib, thereby increasing the strength of the seal between the third rib and the container;

a skirt extending from the lid side portion, the side portion having a first hook and the skirk having a second hook;

the skirt having a tear strip detachable from the side portion at a circumferential position between the first and second hooks;

the container engagable by the first hook and wherein when the lide side portion is stretched over the lip of the container to engage the first hook the lid side portion contacts the lip forming an interference seal that is strengthened by the outward force created by the first circumferential rib on the container side wall; and the container having at least one circumferential ring engagable by the second hook when the tear strip is in place, wherein the lid is secured on the container without threaded engagement either when the tear strip is in place or after it is removed; and wherein the combination of seals forms a liquid tight seal without use of a gasket.

16. The container and lid assembly of claim 15 wherein the circumferential ring provides structural support for the container.

17. The container and lid assembly of claim 15 wherein the third rib is longer than the second rib.

18. A method of sealing a container with a lid, the container having a lip and at least one group of one or more circumferential protrusions, and the lid having a top portion and a side portion extending from the top portion, a first circumferential protrusion, a second circumferential protrusion and a third circumferential protrusion extending from the underside of the lid top portion, the side portion having a hook, the method comprising:

positioning the lid on the container so the container wall is between the first rib and the lid side portion and wherein the first rib is forced against the inner wall of the container;

forcing the lid further onto the container so the third rib is deflected by and contacts the container, the third rib contacts and deflects the second rib but the second rid does not contact the container, the second and third ribs combining to create a single seal wherein the second rib is positioned to exert a spring-like force against the third rib countering the force exerting by the container on the third rib, thereby increasing the strength of the seal between the third rib and the container:

stretching the lid side portion over a lip of the container such that the lide side portion contacts and creates a force against the lip, thereby creating an interference seal; and forcing the lid onto the container to the extent the hook latches onto a protrusion on the container, thus securing the lid on the container without threaded engagement and forming a liquid tight seal without use of a gasket.

19. The method of claim 18 wherein the lid has a skirt with a tear strip and a circumferential hook on the tear strip, the method further comprising:

engaging the hook with a circumferential protrusion on the container; and removing the tear strip.

20. The container lid of claim 1 wherein the first rib is stepped.

21. The container lid of claim 1 configured to fit a 1 to 10 gallon pail and provide a liquid-tight seal when the lid is in place on the container.

* * * * *